US010144584B2

(12) United States Patent
Parker

(10) Patent No.: US 10,144,584 B2
(45) Date of Patent: Dec. 4, 2018

(54) INTERMEDIATE CONTAINER FOR A FRONT LOADING REFUSE CONTAINER

(71) Applicant: The Curotto-Can, LLC, Chattanooga, TN (US)

(72) Inventor: Brian T. Parker, Signal Mountain, TN (US)

(73) Assignee: The Curotto-Can, LLC, Chattanooga, TN (US)

( * ) Notice: Subject to any disclaimer, the term of this patent is extended or adjusted under 35 U.S.C. 154(b) by 295 days.

(21) Appl. No.: 14/043,406

(22) Filed: Oct. 1, 2013

(65) Prior Publication Data

US 2015/0093221 A1 Apr. 2, 2015

(51) Int. Cl.
*B65F 3/04* (2006.01)
*B65F 3/02* (2006.01)

(52) U.S. Cl.
CPC ..... *B65F 3/041* (2013.01); *B65F 2003/023* (2013.01); *B65F 2003/0266* (2013.01); *B65F 2003/0276* (2013.01); *B65F 2003/0279* (2013.01)

(58) Field of Classification Search
CPC ..... B65F 3/0213; B65F 2003/0266; B65F 2003/0279
USPC ..... 414/408
See application file for complete search history.

(56) References Cited

U.S. PATENT DOCUMENTS 2,592,324 A 4/1952 Oliver
2,808,947 A 10/1957 Shippy
3,085,703 A * 4/1963 Dempster ..... B65F 3/04 414/406
3,136,436 A 6/1964 Erlinder et al.
3,174,636 A * 3/1965 Dempster et al. ..... B60P 1/50 414/409
3,196,979 A 7/1965 Garnett
3,462,023 A 8/1969 Grove
3,516,562 A 6/1970 Knight
3,620,579 A 11/1971 Archer
3,690,742 A 9/1972 Sung
3,719,403 A 3/1973 Sung
3,719,404 A 3/1973 Sterner
3,762,586 A * 10/1973 Updike, Jr. ..... B65F 3/04 294/104
3,773,197 A 11/1973 Blakeley et al.
3,786,949 A 1/1974 Sutton
3,822,802 A * 7/1974 Evans, Jr. ..... B65F 3/00 414/373
3,837,502 A 9/1974 Hornagold
3,841,508 A * 10/1974 Ebeling ..... B65F 3/041 298/17 R (Continued)

FOREIGN PATENT DOCUMENTS

DE 102005018476 10/2006
GB 2134072 A 8/1984

*Primary Examiner* — James Keenan
(74) *Attorney, Agent, or Firm* — Fish & Richardson P.C.

(57) ABSTRACT

A collection arm for a refuse vehicle or intermediate container has a collection arm adapted to be coupled with the refuse vehicle or the intermediate container. The refuse arm includes a pivot mechanism to secure it with a bumper of the vehicle or with the container. A telescopic boom is adapted to couple with the pivot mechanism. The boom has a grasping mechanism coupled with an end of the telescopic boom. The grasping mechanism moves garbage cans from a pick up position to an empty position.

16 Claims, 8 Drawing Sheets

(56) References Cited

U.S. PATENT DOCUMENTS 3,844,434 A 10/1974 Blakeley et al.
3,858,927 A * 1/1975 Sutton ..... B65H 1/122 220/DIG. 13
3,881,616 A 5/1975 Blakeley et al.
3,910,433 A * 10/1975 Love ..... B60P 1/50 414/420
3,910,434 A 10/1975 Eberling et al.
3,944,092 A 3/1976 Eberling et al.
3,985,234 A 10/1976 Jouffray
4,016,688 A 4/1977 Tiffin et al.
4,045,936 A 9/1977 Sterner
4,057,156 A 11/1977 Thompson et al.
4,112,649 A 9/1978 Fritsch et al.
4,175,903 A 11/1979 Carson
4,219,298 A 8/1980 Stragier et al.
4,227,849 A 10/1980 Worthington
4,257,201 A 3/1981 Landolt et al.
4,313,707 A 2/1982 Bingman et al.
4,316,695 A 2/1982 Knight, Sr.
4,401,407 A 8/1983 Breckenridge
4,427,333 A 1/1984 Ebeling
4,461,608 A 7/1984 Boda
4,543,028 A 9/1985 Bell et al.
4,597,710 A 7/1986 Kovats
4,669,940 A 6/1987 Englehardt et al.
4,708,570 A 11/1987 Smith et al.
4,726,726 A 2/1988 Dossena et al.
4,759,452 A 7/1988 Faint et al.
4,784,278 A 11/1988 Luscombe
4,872,801 A 10/1989 Yeazel et al.
4,915,570 A 4/1990 Rath et al.
4,981,411 A 1/1991 Ramsey
4,983,092 A 1/1991 Richards
5,002,450 A 3/1991 Naab
5,007,786 A 4/1991 Bingman
5,020,844 A 6/1991 Pickrell
5,026,104 A 6/1991 Pickrell
5,035,563 A 7/1991 Mezey
5,044,863 A 9/1991 LaBass et al.
5,049,026 A 9/1991 Bingman et al.
5,092,731 A 3/1992 Jones et al.
5,163,805 A 11/1992 Mezey
5,186,397 A 2/1993 Orlando
5,205,698 A 4/1993 Mezey
5,209,312 A 5/1993 Jensen
5,209,537 A 5/1993 Smith et al.
RE34,292 E 6/1993 Bingman et al.
5,222,853 A 6/1993 Carson
5,230,393 A 7/1993 Mezey
5,303,841 A 4/1994 Mezey
5,304,744 A 4/1994 Jensen
5,360,310 A 11/1994 Jones et al.
5,391,039 A 2/1995 Holtom
5,398,983 A 3/1995 Ahrens
5,419,671 A 5/1995 Smith et al.
5,470,187 A 11/1995 Smith et al.
5,474,413 A 12/1995 Georg
5,505,576 A 4/1996 Sizemore et al.
5,513,937 A 5/1996 Huntoon et al.
5,513,942 A 5/1996 Pickrell
5,547,332 A 8/1996 Smith et al.
5,551,824 A 9/1996 Zanzig et al.
5,562,386 A 10/1996 Browning
5,577,877 A 11/1996 Smith et al.
5,601,392 A 2/1997 Smith et al.
5,607,277 A * 3/1997 Zopf ..... B65F 3/041 414/408
5,639,201 A * 6/1997 Curotto ..... B65F 1/122 294/86.4
5,651,654 A 7/1997 Christenson
5,702,225 A 12/1997 Ghibaudo
5,711,565 A 1/1998 Smith et al.
5,720,589 A 2/1998 Christenson et al.
5,743,698 A 4/1998 Smith et al.
5,755,547 A 5/1998 Flerchinger et al.
5,759,008 A 6/1998 Smith et al.
5,769,592 A 6/1998 Christenson
5,769,594 A 6/1998 Kalua
5,775,867 A 7/1998 Christenson
5,813,818 A 9/1998 McNeilus et al.
5,813,824 A 9/1998 Zanzig et al.
5,829,606 A 11/1998 Erdmann
5,833,428 A * 11/1998 Szinte ..... 414/408
5,833,429 A 11/1998 McNeilus et al.
5,846,044 A 12/1998 Smith et al.
5,863,086 A 1/1999 Christenson
5,879,015 A 3/1999 Ramsey et al.
5,919,027 A 7/1999 Christenson
5,931,628 A 8/1999 Christenson
5,934,858 A 8/1999 Christenson
5,934,867 A 8/1999 Christenson
5,967,731 A 10/1999 Brandt
5,988,970 A 11/1999 Holtom
6,004,092 A 12/1999 Johnson et al.
6,007,291 A 12/1999 Ghibaudo
6,012,895 A 1/2000 Smith et al.
6,027,300 A 2/2000 Richards
6,071,058 A 6/2000 Tetz et al.
6,089,813 A 7/2000 McNeilus et al.
6,095,744 A 8/2000 Harrison
6,139,244 A * 10/2000 VanRaden ..... B65F 3/041 414/408
6,167,795 B1 * 1/2001 Bayne ..... B65F 3/08 414/408
6,174,126 B1 1/2001 Zanzig et al.
6,183,185 B1 2/2001 Zanzig et al.
6,210,094 B1 4/2001 McNeilus et al.
6,213,706 B1 4/2001 Christenson
6,273,632 B1 8/2001 Takahashi et al.
6,325,587 B1 * 12/2001 Wysocki ..... B65F 1/004 220/909
6,350,098 B1 2/2002 Christenson et al.
6,390,758 B1 5/2002 McNeilus et al.
6,474,928 B1 11/2002 Christenson
6,491,489 B1 12/2002 Stragier
6,494,665 B1 12/2002 Bingman
6,520,008 B1 2/2003 Stragier
6,644,906 B2 11/2003 Bayne
6,655,894 B2 12/2003 Boivin
6,719,226 B2 4/2004 Rajewski
6,726,437 B2 4/2004 Albright et al.
6,761,523 B2 7/2004 Hund, Jr. et al.
6,776,570 B1 8/2004 Thobe et al.
6,821,074 B2 11/2004 Schreiber et al.
7,037,061 B2 5/2006 Hund, Jr. et al.
7,066,514 B2 6/2006 Smith et al.
7,070,381 B2 7/2006 Khan et al.
7,086,818 B2 8/2006 Pruteanu et al.
7,293,377 B2 11/2007 Pinther et al.
7,347,657 B2 3/2008 Brunn
7,390,159 B2 * 6/2008 Rimsa ..... B65F 3/046 414/408
7,452,175 B2 11/2008 Martin et al.
7,559,732 B2 7/2009 Khan et al.
7,559,733 B2 7/2009 Khan et al.
7,559,734 B2 7/2009 Khan et al.
7,559,735 B2 7/2009 Pruteanu et al.
7,748,908 B2 7/2010 Aira et al.
7,871,233 B2 1/2011 Arrez et al.
8,550,764 B2 * 10/2013 Rowland ..... B65F 3/041 414/408
8,827,559 B2 * 9/2014 Gentry ..... F16B 7/10 384/35
9,028,193 B2 * 5/2015 Goedken ..... B65F 9/00 414/408
9,296,558 B2 * 3/2016 Parker ..... B65F 3/041
2001/0001637 A1 5/2001 Zanzig et al.
2002/0159870 A1 10/2002 Pruteanu et al.
2003/0152454 A1 8/2003 Albright et al.
2003/0175104 A1 9/2003 Pruteanu
2005/0095096 A1 * 5/2005 Curotto ..... B65F 1/122 414/406
2005/0232736 A1 10/2005 Fellows et al.

(56) References Cited

U.S. PATENT DOCUMENTS

| | | | | |
|---|---|---|---|---|
| 2006/0280582 | A1 | 12/2006 | Kouri | |
| 2008/0199290 | A1 | 8/2008 | Traylor | |
| 2009/0067965 | A1 | 3/2009 | Martin et al. | |
| 2009/0317219 | A1 | 12/2009 | Pruteanu et al. | |
| 2010/0209181 | A1 | 8/2010 | Gokita | |
| 2010/0322749 | A1 | 12/2010 | Rowland et al. | |
| 2011/0038697 | A1 | 2/2011 | Arrez et al. | |
| 2011/0243692 | A1 | 10/2011 | Fortin et al. | |
| 2013/0039728 | A1 | 2/2013 | Price et al. | |
| 2014/0056637 | A1 | 2/2014 | Gentry | |
| 2014/0341685 | A1* | 11/2014 | Ford | B65F 3/041 414/408 |
| 2015/0030419 | A1* | 1/2015 | Goedken | B65F 3/04 414/408 |

* cited by examiner

INTERMEDIATE CONTAINER FOR A FRONT LOADING REFUSE CONTAINER

FIELD

The present disclosure relates to intermediate containers for front loading refuse vehicles and, more particularly, to an intermediate can that includes a pivotal arm on the container or the front bumper of the vehicle.

BACKGROUND

Various types of containers have been disclosed. U.S. Pat. Nos. 8,496,427; 8,092,141; 7,553,121, and 7,210,890 exist in the art. These intermediate containers are known in the art as Curotto cans. The Curotto cans usually include a side loading robotic arm at the rear of the container. Also, prior Curotto can patents illustrated the side loading robotic arm at the front of the container. The arm is movable in a slide that is secured on the outer wall of the container. While these types of side loading arms on intermediate containers work satisfactorily for their intended purposes, designers strive to improve the art.

Accordingly, the present disclosure provides an intermediate container with a telescoping side loading arm. The side loading arm may be pivotally connected to the front bumper of the refuse vehicle. Alternatively, the side loading robotic arm may be pivotally attached to the front or rearmost wall of the intermediate container, when the intermediate container is positioned on the front loading forks of a refuse collection vehicle. Alternatively, the side loading arm may be pivotally connected with the sidewalls of the intermediate container. Additionally, the arm may pivotally connected within the intermediate container.

SUMMARY

Accordingly to a first aspect of the disclosure, a refuse vehicle with a front loading mechanism has an intermediate collection container coupled with the forks of the front loading mechanism. A collection arm, for picking up refuse cans, is mounted on a front bumper of the refuse vehicle. The collection arm includes a pivot mechanism to enable vertical adjustment of the collection arm. A pivot is positioned on the bumper and is coupled with the collection arm pivoting mechanism. A pivot bearing assembly removably couples the telescoping boom and is adapted to couple with the bumper. The collection arm provides telescoping movement of the grabber to move the grabber toward and away from the refuse vehicle.

According to a second aspect of the disclosure, an intermediate can, to couple with the fork of a front loaded refuse vehicle, comprises a bottom wall, a front wall, a rear wall and a pair of side walls between the front and rear walls forming the intermediate can. A telescoping boom is adapted to be coupled with a wall of the intermediate can. A grasping mechanism is coupled with an end of the telescoping boom. The grasping mechanism is adapted to grasp refuse cans. The telescoping boom is pivotally secured to a wall of the intermediate container. A pivot bearing assembly removably couples the telescoping boom and is adapted to couple with the intermediate container wall. The arm enables pick up of refuse cans above and below grade of a surface on which the vehicle is traveling.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figure 1:
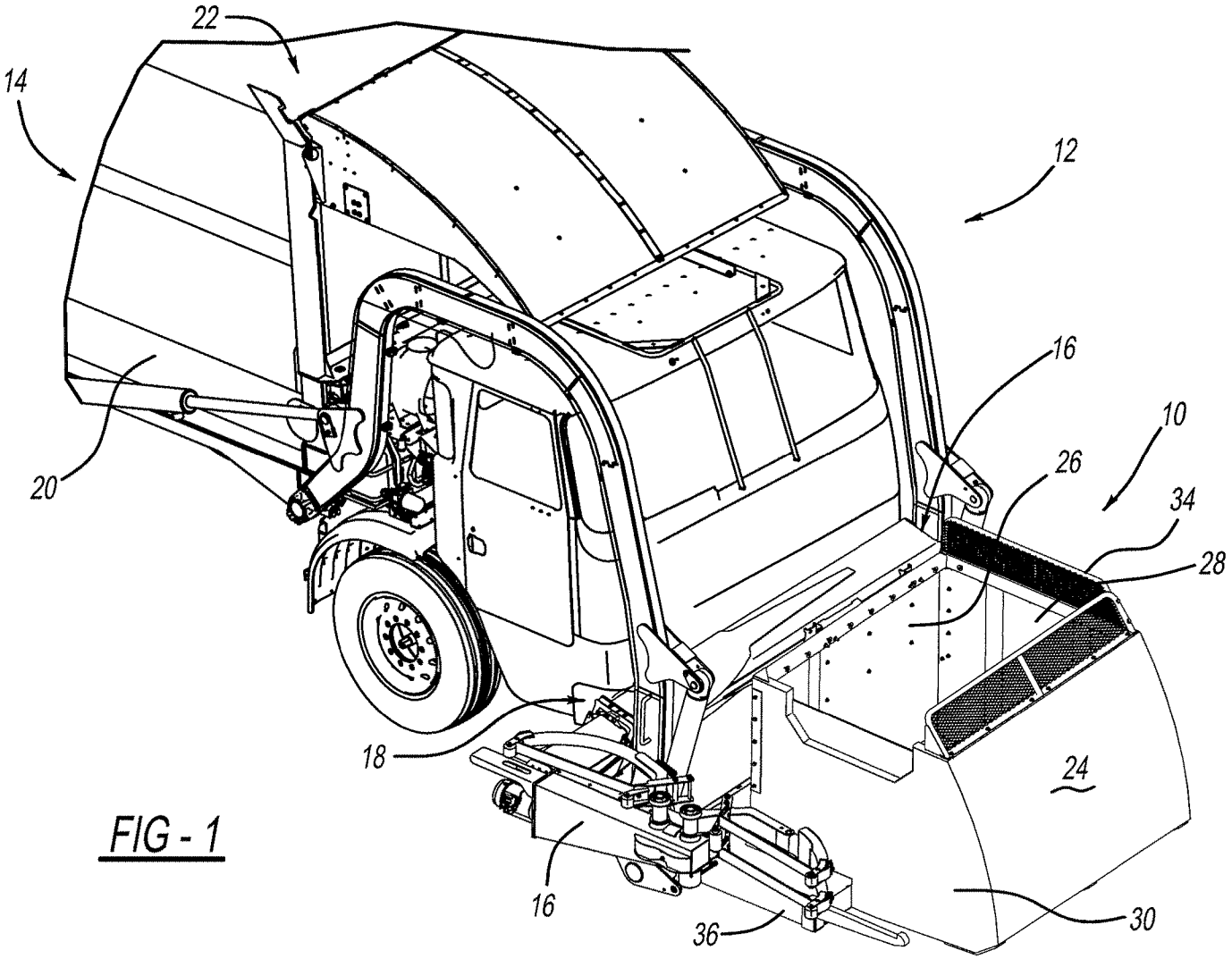
FIG. 1 is a perspective view of an intermediate can and a collection arm positioned on a refuse vehicle.
Figure 2:
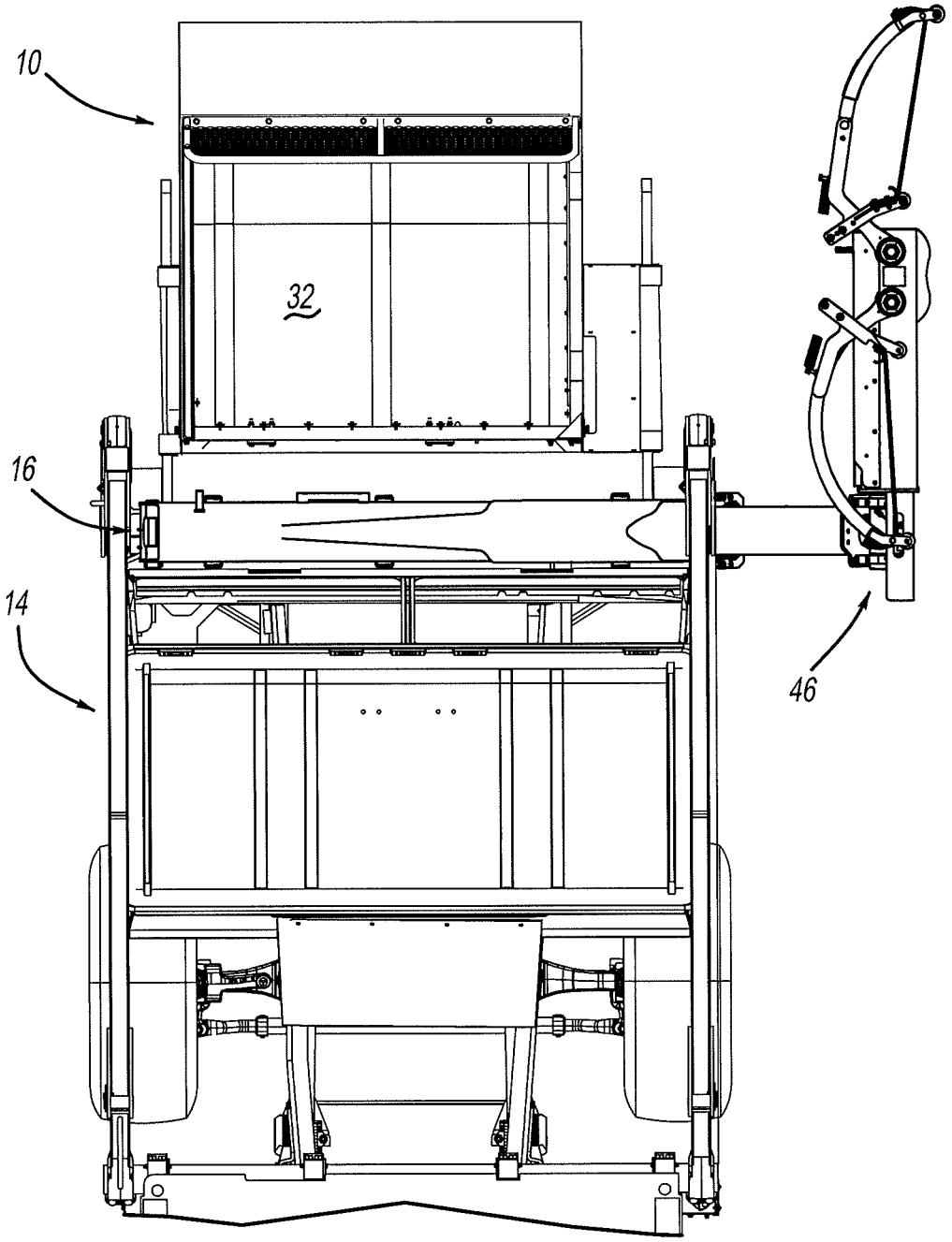
FIG. 2 is a top plan view of FIG. 1.

Example embodiments will now be described more fully with reference to the accompanying drawings.

Turning to the figures, an intermediate can 10 is loaded on the front loading forks 12 of a refuse collection vehicle 14. A collection arm 16 is mounted on the bumper 18 of the refuse collection vehicle 14. The refuse collection vehicle 14 includes a mounted container 20 that includes an open hopper 22 that receives refuse from the intermediate can 10.

The intermediate can 10 has an overall box shape with a front wall 24, a rear wall 26, sidewalls 28, 30, a bottom 32 and an open top 34. Thus, refuse can be positioned into the intermediate container 10 through the open top 34 and retained in the intermediate container 10 until it is dumped into the hopper 22. Also, the intermediate container 10 includes a pair of channels 36 that enable the forks 12 to pass therethrough to enable lifting and transporting of the intermediate container 10.

The container collection arm 16 includes a telescoping boom 42 and a grasping assembly 44. The grasping assembly 44 is secured to the boom 42 via a rotary actuator 46. The rotary actuator 46 manipulates the grasping assembly 44 to level the refuse can during lifting. Additionally, the rotary actuator 46 initiates dumping of the container into the intermediate container 10. A hose track 48, housing the hydraulic hoses, is positioned on the boom 42. The hydraulic hoses are carried by the hose track 48 to the rotary actuator 46 and grasping assembly. The hose track 48 moves along the boom 42.

The grasping assembly 44 includes a link arm 45 coupled with the rotary actuator 46. Additionally, a pair of fingers 41, 43 is actuated from the link arm 45 to capture the refuse can. The link arm 45 is illustrated in a non-offset position for close gripping of the refuse can or for a storage position. The fingers 41, 43 include a sensor 49. The sensor 49 may be of the pressure or positioning type to enable proper positioning of the gripping mechanism fingers 41, 43 on the refuse can prior to the dump sequence. Additionally, the fingers 41, 43 may include a sensor such as a load cell 51 or the like that enables a determination of the weight of the refuse can prior to the dumping sequence. By determining the weight of the refuse can, dynamically, this enables the speed of the arm 16, during the dump sequence, to be adjusted based upon the weight of the refuse can. Thus, with a lightweight refuse can, the boom 42 may operate rapidly through the dump sequence to dump the refuse can. In the event the refuse can is heavy (e.g., 100 to 300 lbs.), the boom 42 can lift the refuse can slowly and proceed through the dump sequence to dump the refuse can at a slower speed. Alternatively, the hydraulic system could be utilized, via an algorithm relating weight to the pressure/flow characteristics, to determine the weight of the refuse can. Thus, the hydraulic pressure could be monitored to determine the weight and thus the sequence of dumping the refuse can.

The boom 42 generally includes a plurality of stages that enable the boom 42 to telescope outward and inward to pick up and dump a refuse can. The boom 42, with stages, can have a desired length and is preferably between 8 to 16 feet.

The boom 42 is secured onto the bumper 18 by a mounting assembly 50 and a movable cylinder 52. The mounting assembly 50 is secured to the bumper 18. A bearing journal 56 enables the boom 42 to rotate about the bearing journal axis. The mounting assembly 50 includes a base 54. The base 54 includes the bearing journal 56 that receives the boom 42. The bearing journal 56 is positioned inside of a base 54 that is secured to the bumper, as illustrated in FIG. 3.

The pivot cylinder 52 includes a trunnion 62 mounted in a trunnion mount 60. The trunnion mount 60 enables the cylinder 52 to pivot along the axis of the trunnion pin 62. Thus, as the cylinder 52 is extended and retracted, the trunnion mount 60 enables the piston to rotate about the trunnion pin axis. As this occurs, the boom 42 is rotated about the bearing journal 56 which provides vertical movement at the end of the boom 42 that includes the rotary actuator 46. The cylinder 52 includes a mounting pin 64 that passes through a clevis 66 on the boom 42 so that the cylinder 52 is rotatably secured with the boom 42.

Figure 3:
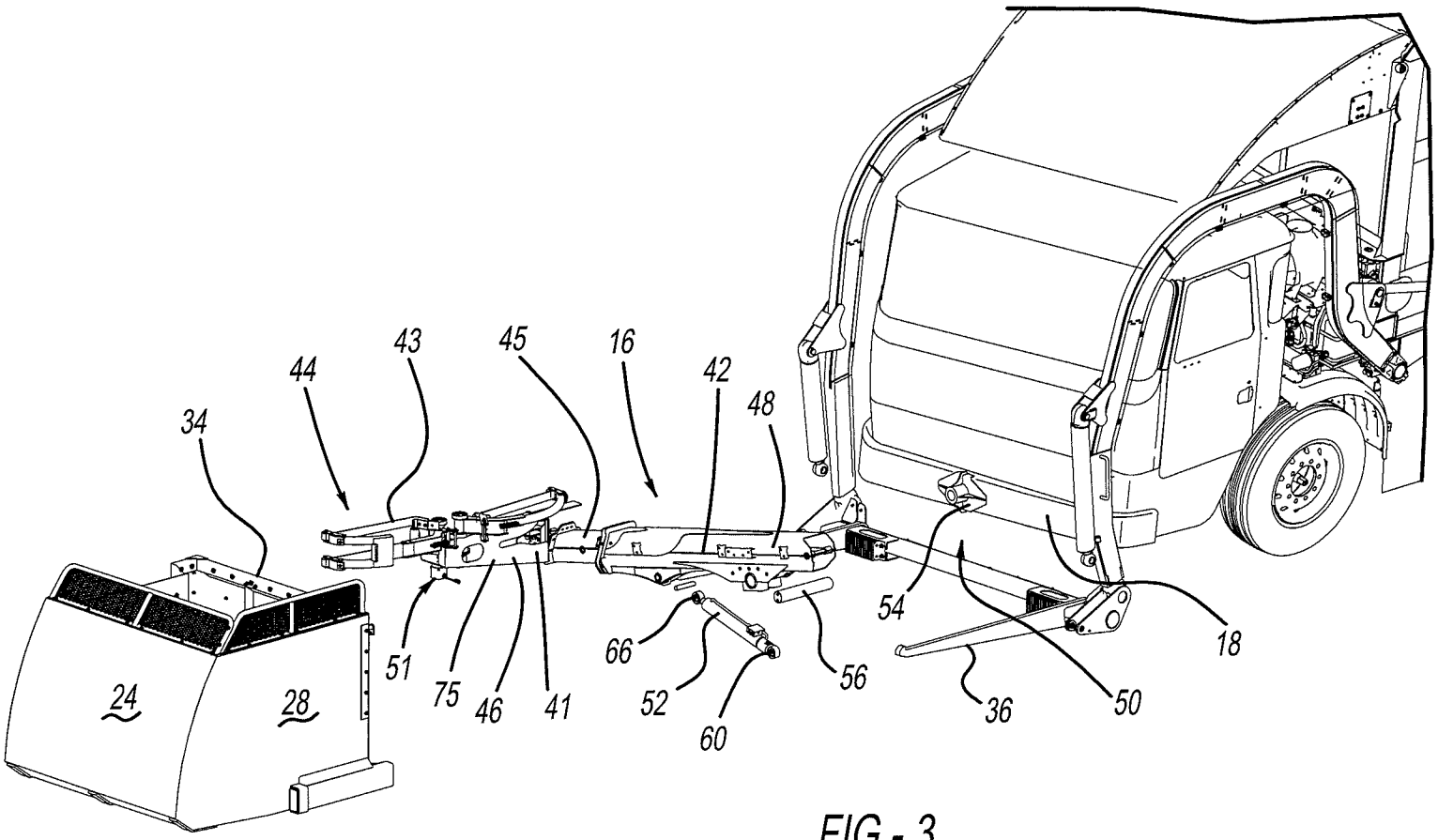
FIG. 3 is an exploded view of FIG. 1.

As can be seen in FIG. 3, due to the nature of the mounting assembly 50, the container collection arm 16 can be easily removed from the mounting assembly 50. The container collection arm 16 can easily be repaired or replaced.

Thus, by actuating the cylinder 52, the boom 42 may be moved in a first degree of movement to provide vertical movement of the grasping assembly 44. Additionally, the boom 42 can be extended to provide a second degree of freedom of movement to move the grasping assembly horizontally. Further, the rotary actuator 46 can be rotated up and/or down to compensate for grasping the refuse can. Thus, the container collection arm 16 is capable of picking up containers above and below the street grade the vehicle is traveling on. Additionally, the movement enables the opening of the refuse can to remain parallel to the ground regardless of the grade. Thus, this prevents tipping and loss of refuse in the refuse can.

Additionally, an operator override may be present to enable the grasping of refuse cans that are above and below the street grade of the vehicle. This requires the arm to be taken out of a normal range of operation for grasping the refuse can. The grasping sequence can be overridden by the operator so that the refuse can may be picked up above and below street grade of the vehicle.

The container collection arm 16 moves between a pickup and a dump position. In the pickup position, the boom 42 is extended slightly when the refuse can is on the ground and grasped by the grasping mechanism 44. The boom 42 is rotated upwardly as the piston cylinder 52 is extended. Additionally, the rotary actuator 46 compensates to maintain the refuse can in an upright position. The piston cylinder 52 continues to extend as the boom continues to retract. Also, the rotary actuator 46 continues to rotate until the container reaches a dump position. The rotary actuator 46 is rotated so that the container dumps into the intermediate container 10. At this position, the rotary actuator 46 can be moved in a forward and reverse direction to "shake" the refuse can to provide an extra refuse evacuation sequence during dumping. Alternatively, a vibration mechanism may be secured with the grasping mechanism 44 to "shake" the refuse can to provide an extra refuse evacuation sequence during dumping. The cylinder 52, boom 42 and rotary actuator 46 are activated to reposition the refuse can back onto the ground surface. Thus, the container collection arm 16 enables the container to be brought to a dumping location in a direct path from any reached distance while maintaining the refuse can in an upright condition. This reduces the possibility of spillage of the refuse can contents.

The rotary actuator 46 ensures that the refuse can is emptied. The rotary actuator, vibration mechanism, or other shaking devices, not directly related to the lifting motion, will enable the refuse can to be emptied without adding loads and stresses to the main lifting stages of the boom 42. Additionally, a system to determine whether the container is empty may be added to the container collection arm 16. It will automatically modify the container collection arm 16 motion to empty the refuse can. Refuse can status can be derived from a number of methods such as weight, visual sensing, ultrasonic radar or the like which will transmit a signal back to the main lift controller. The information will be used to either initiate shaking of the refuse can to empty its contents or prevent the operator from extraneous shaking movement of the refuse can. This reduces wear on the lifting arm and increases operator productivity by eliminating unneeded actions at each collection point.

Additionally, a sensor 75 may be positioned on the rotary actuator link arm 45. The sensor 75 ensures that the link arm 45 is level with the grade of the ground. This enables the refuse can opening to always remain parallel with the ground prior to the dump sequence. This auto leveling feature enhances the ability to enable the refuse can to be maintained upright as well as to be in a proper position for dumping. Also, sensor 75 will allow for the link arm 45 and grasping mechanism 44 to be rotated to a perpendicular position in reference to the ground so that containers that are not in an upright position can be collected.

A hydraulic system (not shown) is used to operate the grasping assembly 44 and the piston cylinder 52. The hydraulic system is coupled with the vehicle hydraulic system.

Figure 4:
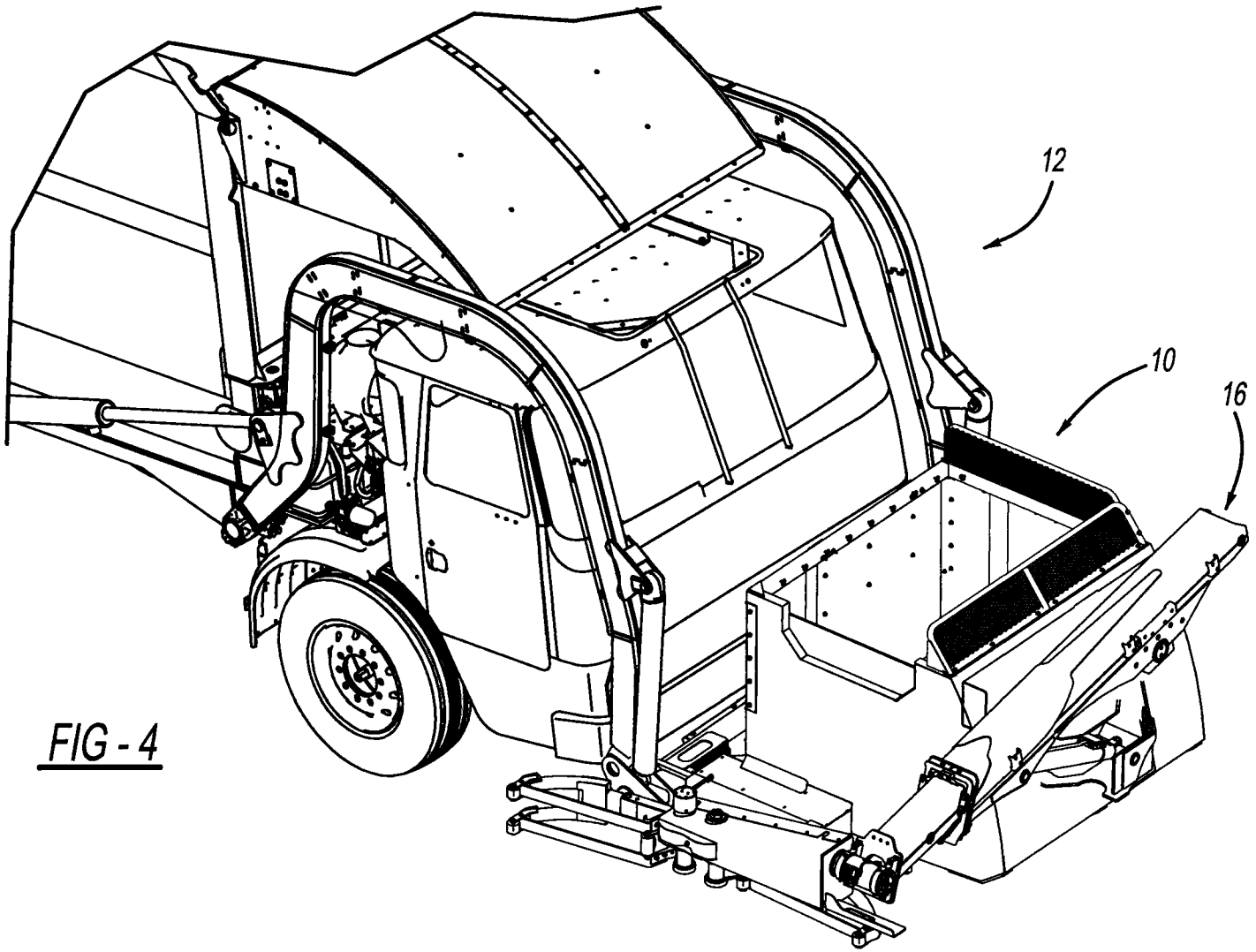
FIG. 4 is a perspective view of an intermediate can with a mounted collection arm.
Figure 5:
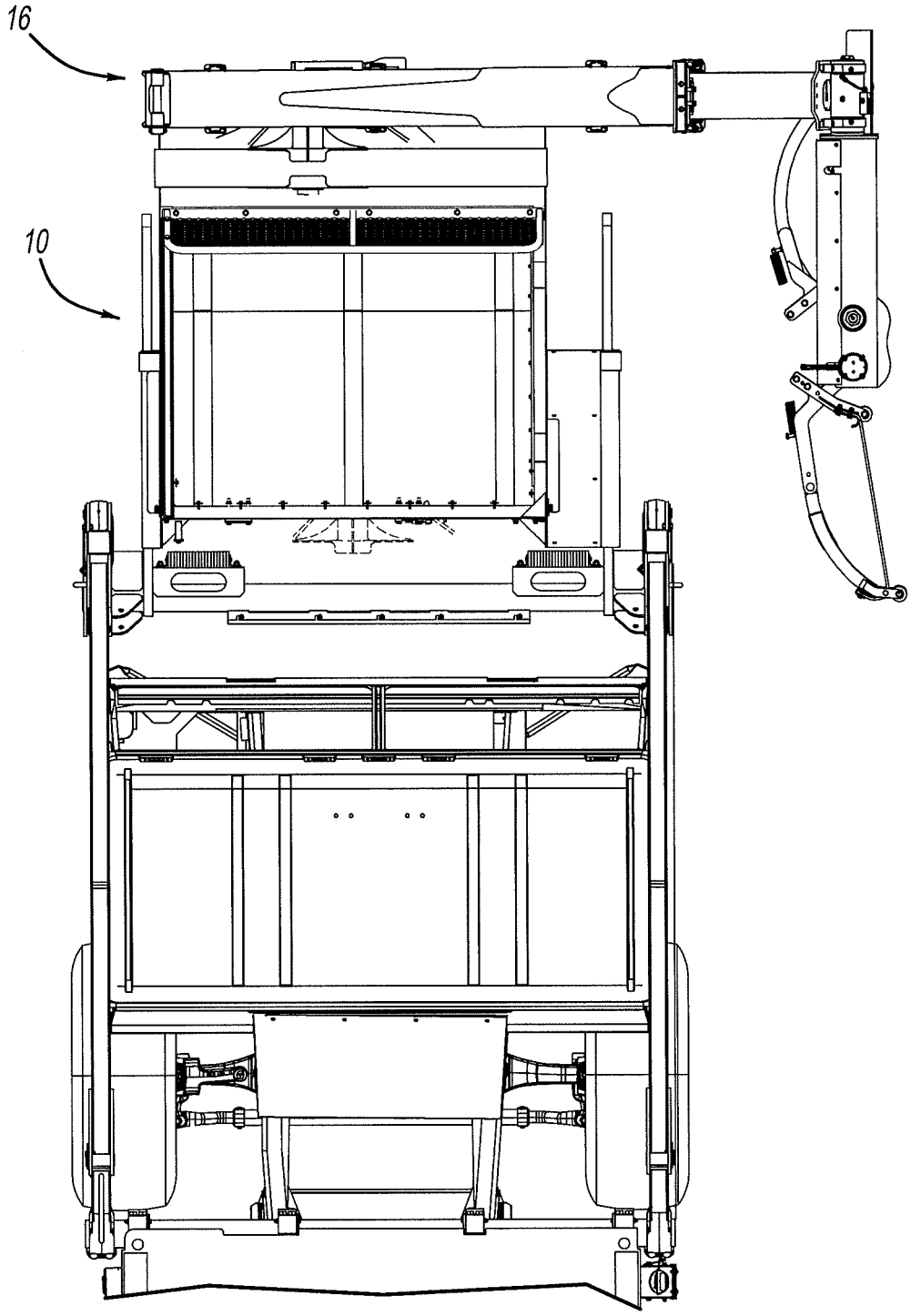
FIG. 5 is a top plan view of FIG. 1.
Figure 6:
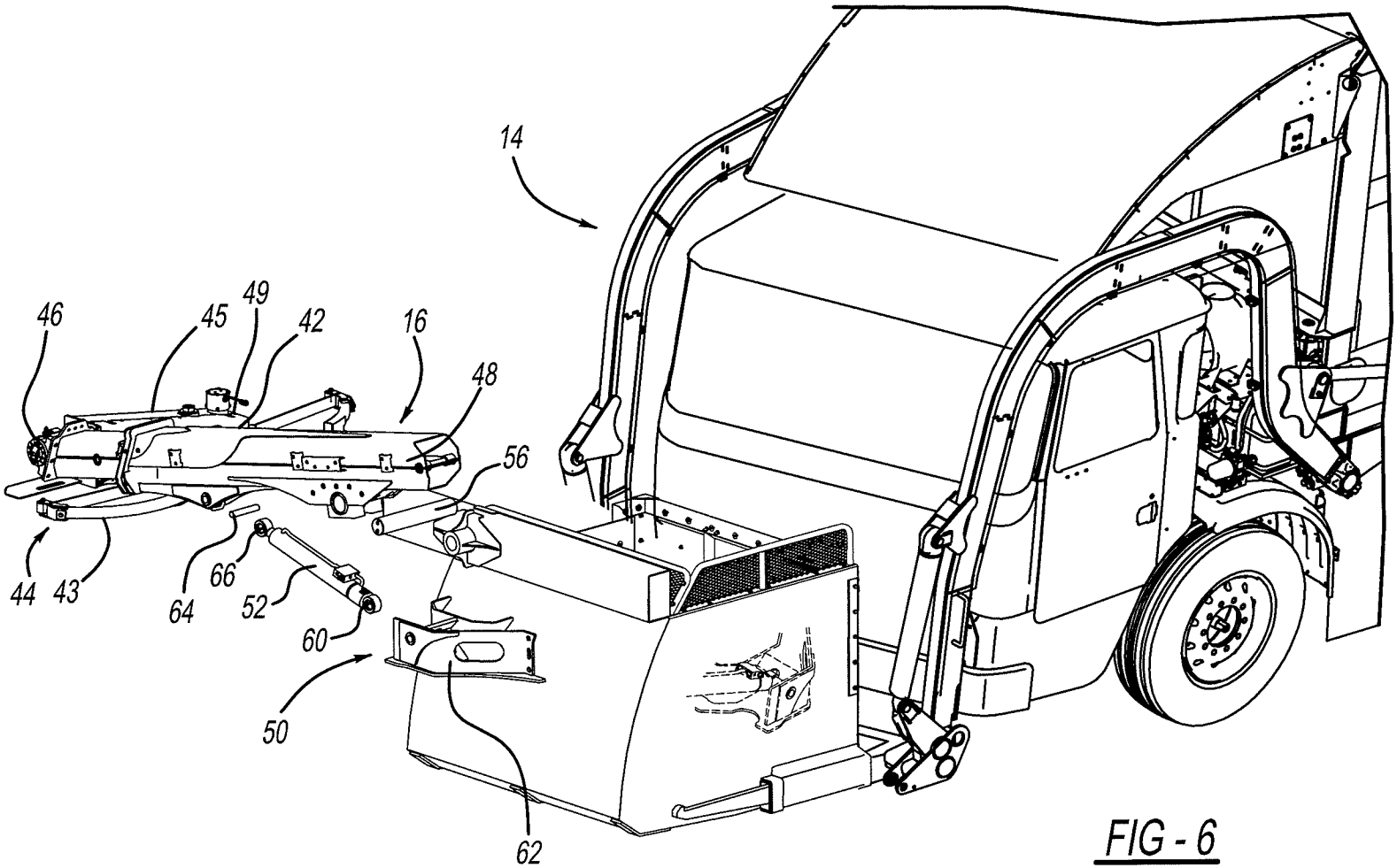
FIG. 6 is an exploded view of FIG. 4.

Turning to FIGS. 4-6, an alternative embodiment is illustrated. Here, the collection arm is like that previously discussed. The collection arm 16 is positioned on the front wall 24 of the container. The collection arm 16 and mounting assembly 50 and movable cylinder 52 are the same as those previously described. Thus, the same reference numerals are utilized to identify the features of the collection arm. The collection arm 16 operates as previously described.

Additionally, the collection arm 16 may be positioned onto the rear wall 26 or either side wall 28, 30 of the intermediate container 10.

Figure 7:
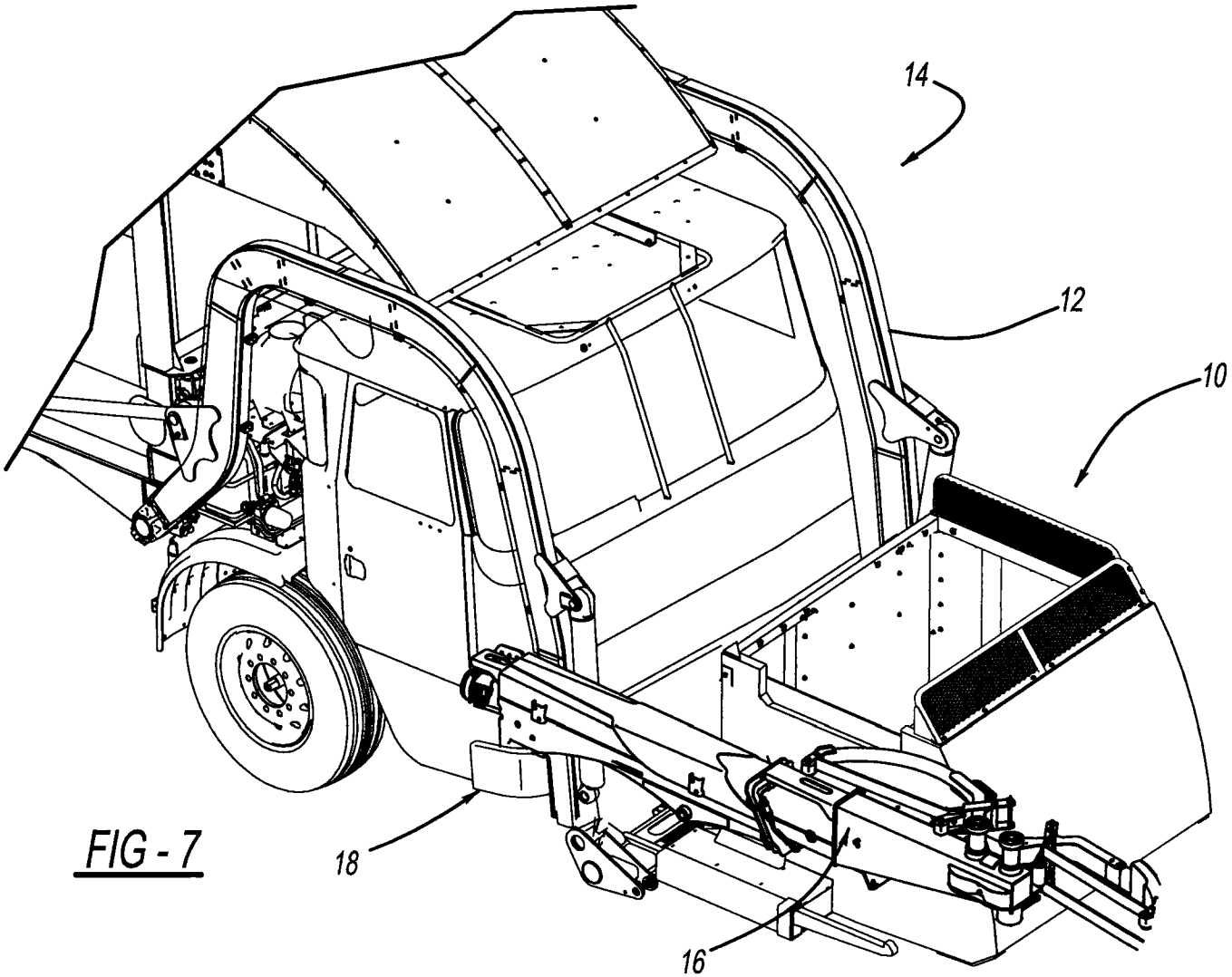
FIG. 7 is a perspective view of another embodiment of the intermediate can and collection arm.

Turning to FIG. 7, the collection arm 16 is illustrated mounted on top of the bumper 18. Here, the mounting assembly 50 is mounted to the top of the bumper. The collection arm 16 operates as disclosed above.

Figure 8:
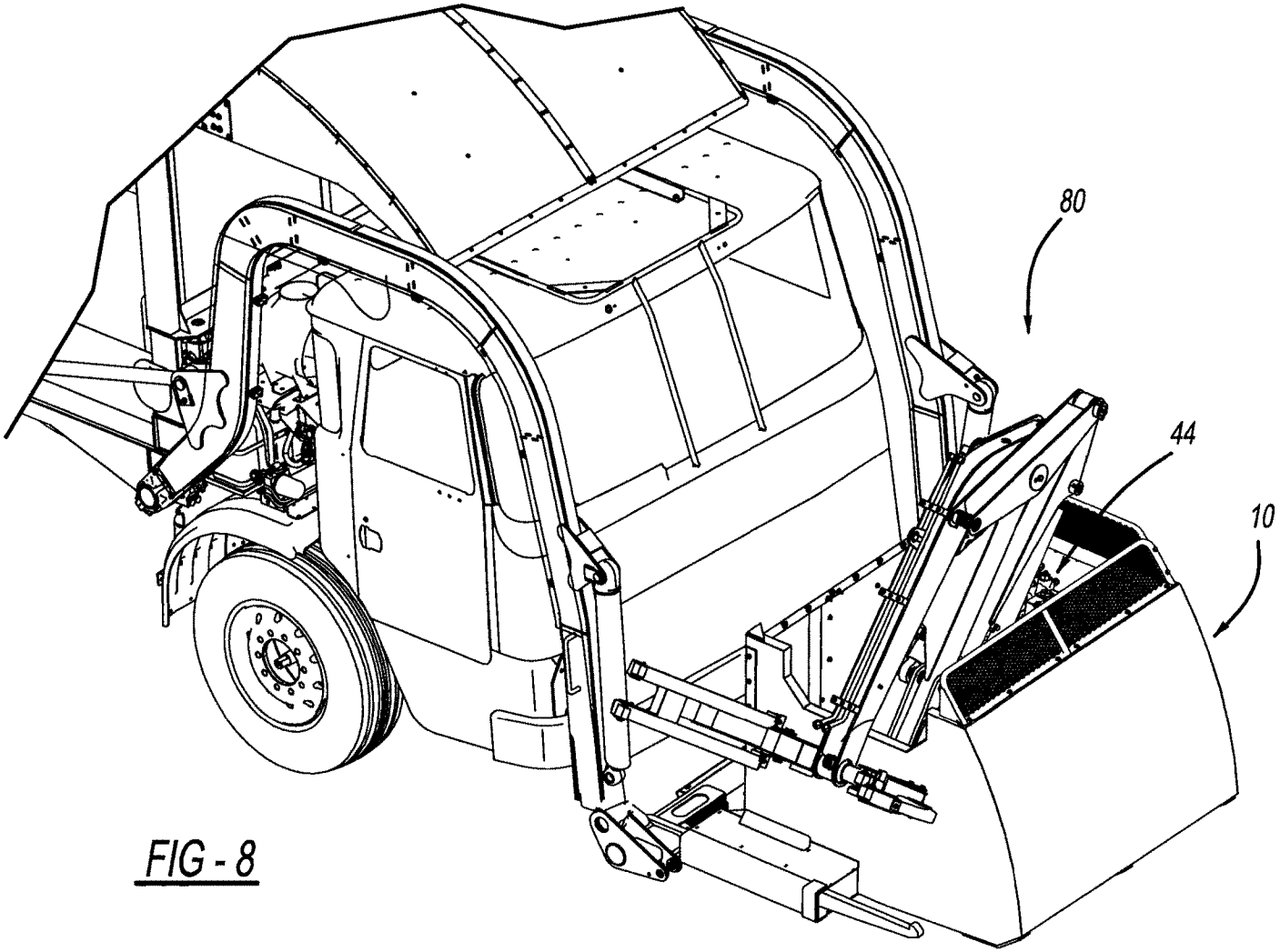
FIG. 8 is a perspective view of an alternate embodiment of the intermediate can and collection arm.

FIG. 8 illustrates an additional embodiment of the apparatus. Here, a knuckle boom lift 80 is positioned inside of the intermediate container 10. The knuckle boom 80 lift is capable of moving outside of the intermediate can 10 to pick up a refuse can to dump it inside the intermediate container 10. The grasping assembly 44 is connected to the knuckle boom lift 80 by a rotary motor 46 so that upon picking up the refuse can and returning it to the intermediate container 10. The refuse can be dumped into the intermediate container 10.

The description of the disclosure is merely exemplary in nature and thus, variations that do not depart from the gist of the disclosure are intended to be within the scope of the disclosure. Such variations are not to be regarded as a departure from the spirit and scope of the disclosure.

What is claimed is:

1. A refuse vehicle having a front loading fork mechanism comprising:

an intermediate collection container coupled with the fork mechanism;

a collection arm for picking up refuse cans, the collection arm mounted on a front bumper of the refuse vehicle;

the collection arm including a boom, grasping arm, and a pivot mechanism for enabling vertical adjustment of the collection arm;

a pivot journal extending from the bumper, the collection arm pivot mechanism rotatably coupled with the pivot journal;

the boom is rotatable with respect to the pivot journal so that the rotation of the boom about the pivot journal adjusts a vertical position of the grasping arm with respect to refuse cans, an actuator coupled with the boom and grasping arm for rotating the grasping arm with respect to the boom to adjust the vertical position of the grasping arm with respect to the boom to move the grasping arm and refuse cans into a dump position for dumping the refuse cans into the intermediate container; and the grasping arm, in a retracted position, positioned on a side of the refuse vehicle and immediately adjacent to a sidewall of the intermediate collection container enabling dumping of the intermediate collection container by the fork mechanism.

2. The refuse vehicle of claim 1, wherein the arm is telescoping providing movement of the collection arm toward and away from the vehicle.

3. The refuse vehicle of claim 1, wherein the pivot is mounted on the front of the bumper.

4. The refuse vehicle of claim 1, wherein the pivot is mounted on top of the bumper.

5. The refuse vehicle of claim 1, wherein the pivot mechanism enables lateral adjustment of the collection arm.

6. The refuse vehicle of claim 1, further comprising a hopper coupled to a chassis of the vehicle, the hopper configured to receive refuse contained by the intermediate collection container when the intermediate collection container is dumped by the fork mechanism.

7. The refuse vehicle of claim 1, further comprising a hose track positioned on the boom, the hose track configured to move along the boom while carrying one or more hoses to at least one of the actuator or the grasping arm.

8. The refuse vehicle of claim 1, further comprising a pair of fingers coupled to the grasping arm, the fingers configured to grip the refuse cans.

9. The refuse vehicle of claim 8, further comprising a weight sensor coupled to at least one finger of the pair of fingers.

10. The refuse vehicle of claim 1, further comprising a cylinder coupled to the boom, and wherein the cylinder is mounted such that extension and retraction of the cylinder causes rotation of the boom.

11. The refuse vehicle of claim 10, wherein the boom is configured to extend and retract telescopically, and wherein the cylinder is configured to extend to rotate the boom as the boom retracts.

12. The refuse vehicle of claim 1, wherein the collection arm pivot mechanism is releasably coupled with the pivot journal.

13. The refuse vehicle of claim 1, wherein the intermediate collection container comprises an open cavity defined by a front wall, a rear wall, opposing side walls, and a bottom wall, and wherein at least a portion of the boom resides rearward of the rear wall.

14. The refuse vehicle of claim 1, wherein the actuator comprises a rotary actuator.

15. The refuse vehicle of claim 1, wherein the actuator is configured to rotate the grasping arm to a perpendicular position in reference to a ground surface supporting the refuse vehicle.

16. The refuse vehicle of claim 1, wherein the actuator is configured to rotate the grasping arm in opposite directions while the grasping arm and the refuse cans are in the dump position.

* * * * *